US008544603B1

(12) United States Patent
Rullo et al.

(10) Patent No.: US 8,544,603 B1
(45) Date of Patent: Oct. 1, 2013

(54) FALL RESTRICTION DEVICE FOR CLIMBERS OF WOOD POLES

(75) Inventors: James J. Rullo, Binghamton, NY (US); James Pennefeather, Johnson City, NY (US); DeForest C. Canfield, Oxford, NY (US)

(73) Assignee: Buckingham Manufacturing Company, Inc., Binghamton, NY (US)

( * ) Notice: Subject to any disclaimer, the term of this patent is extended or adjusted under 35 U.S.C. 154(b) by 0 days.

(21) Appl. No.: 12/879,289

(22) Filed: Sep. 10, 2010

(51) Int. Cl.
*A62B 35/00* (2006.01)

(52) U.S. Cl.
USPC ..... 182/9

(58) Field of Classification Search
USPC ..... 182/9, 133, 136; 24/598.1–598.4, 24/598.7–601.2, 601.4–601.7; 2/336, 338, 2/340; D8/356, 382, 383
See application file for complete search history.

(56) References Cited

U.S. PATENT DOCUMENTS

| | | | | |
|---|---|---|---|---|
| 1,877,702 | A * | 9/1932 | St Clair | 24/598.4 |
| 5,137,113 | A | 8/1992 | Lortie | |
| 5,141,074 | A * | 8/1992 | Sulowski et al. | 182/9 |
| 5,329,675 | A * | 7/1994 | McLean et al. | 24/599.6 |
| D429,996 | S * | 8/2000 | Fiorentino | D8/356 |
| 6,752,242 | B1 | 6/2004 | Whitehead et al. | |

* cited by examiner

*Primary Examiner* — James O Hansen
*Assistant Examiner* — Kristine Florio
(74) *Attorney, Agent, or Firm* — George R. McGuire; Bond Schoeneck & King, PLLC

(57) ABSTRACT

A fall restriction apparatus for climbers of wooden poles having a connecting component with at least a first bight portion adapted for connection to and retention within a center opening of a three slot-opening D-ring. The connecting component is sized so that when inserted within the central opening, it is restrained from rotating. The connecting component may have outwardly directed protrusions on at least its spine region. The affixed D-ring shape typically lies in a major plane orthogonal to a plane in which the remainder of the connecting component lies. Alternately, connecting component may be attached to other openings of the three-opening D-ring. The fall restriction apparatus also contains a buckle assembly which may have one or more cleats disposed on a rear surface to facilitate gripping a wooden pole.

5 Claims, 11 Drawing Sheets

Prior Art FIG.3a

FALL RESTRICTION DEVICE FOR CLIMBERS OF WOOD POLES

RELATED APPLICATIONS

This application is related to U.S. Pat. No. 6,752,242, included herein in its entirety by reference. The '242 patent and the present application are commonly assigned.

FIELD OF THE INVENTION

The present invention relates to pole climbing equipment and, more particularly, to a wood pole fall restriction device for linemen and pole climbers for use in conjunction with a body belt and adjustable positioning device to protect the user in the event of a cut-out.

BACKGROUND OF THE INVENTION

Injuries sustained by linemen and pole climbers are legendary. Consequently, many devices to prevent falls have been proposed and are in common use by linemen, pole climbers, and others engaged in aerial endeavors.

U.S. Pat. No. 5,137,113, for example, LINEMAN'S SAFETY STRAP ASSEMBLY, issued Aug. 11, 1992 to Michel Lortie teaches a safety strap assembly that incorporates a climber's body belt. The LORTIE strap assembly consists of a pole strap having two ends with a loop extending from a base plate attached to the body belt. The loop may be opened to allow the user to respectively engage and disengage the loop from the utility pole. A brake mechanism is attached to the base plate. The brake mechanism comprises a cam that engages a strap or cross belt of the body belt as it passes over the brake plate. The cam is adjustable by a lever, providing frictional force between the cross belt and the brake plate. The friction applied to the cross belt prevents it from sliding past the brake plate and subsequently tightening the loop.

The LORTIE safety strap assembly and other such devices allow the lineman or pole climber to push the pole strap up or down the pole as he or she ascends or descends the pole. For brevity, the terms he and his as used herein are meant to include the female pronouns, she and hers. In the event the lineman loses his footing on the pole, a tugging force applied by the body belt will release the brake mechanism, thus tightening of the loop of the safety strap, so that the safety strap is tightened about the pole to prevent or limit a fall.

Although the LORTIE safety strap assembly works to prevent a fall in the course of normal operation, it has two major drawbacks. First, the LORTIE safety strap does not allow the lineman to twist his body while he is working. Should the lineman twist his body using this safety strap assembly, the body strap will tug upon the brake mechanism, causing it to release and tighten the loop of the safety strap. The lineman would then have to readjust the safety strap in order to ascend and descend the pole. Therefore, in the normal course of a work shift the lineman would be required to adjust and readjust this safety strap assembly too many times for reasonable comfort and control. More importantly, the LORTIE safety strap assembly does not protect the lineman when he has to maneuver around obstacles.

It would therefore be advantageous to provide a strap assembly for linemen that safeguards against injuries and falls.

It would also be advantageous to provide a strap assembly that allows a lineman to twist his body while he is working.

It would further be advantageous to provide a strap assembly that protects a lineman while he maneuvers around obstacles.

SUMMARY OF THE INVENTION

In accordance with the present invention, there is provided a fall restriction device for linemen and other climbers of wood poles. The inventive device allows the user to ascend and descend a wood pole, but in the event of a cutout (a leading cause of injuries to line technicians and wood pole climbers), an obstruction, or an obstacle, the straps of the wood pole fall restriction device of this invention tighten around the wood pole to arrest or limit a fall.

The wood pole fall restriction device has an inner, positioning strap having a buckle for adjusting the strap. The buckle may have one or more cleats disposed on a rear surface and is attached to one of two locking snap hooks. The buckle allows the line technician to adjust the strap of the device for proper positioning about the pole. The inner strap passes through, and is slidable in, a unique connector that attaches to the outer strap. The connector has a substantially rectangular, oval or square cross section in at least a second bight area designed to fit within a mating, central opening in a three-slot D-ring. The interaction of the substantially rectangular, oval or square cross section of the connector in the slotted D-ring central opening prevents rotation of the connecting component with respect to the three-opening D-ring.

It is, therefore, an object of the invention to provide a fall restriction device wherein the three-slot D has a rectangular, oval or square center slot and larger outside slots adjacent.

It is another object of the invention to provide a fall restriction device wherein a connector assembly may include a D-piece assembly.

It is an additional object of the invention to provide a fall restriction device that includes a connector assembly having pole-gripping protrusions on an outer surface thereof.

It is a further object of the invention to provide a fall restriction device having a buckle assembly having one or more cleats disposed on a rear surface thereof.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein:

FIGS. 3*a*-3*c* are two bottom views and an end view, respectively of a conventional buckle assembly forming part of the fall restriction device of FIG. 1;

DETAILED DESCRIPTION OF THE PREFERRED EMBODIMENT

The present invention provides a fall restriction device for climbers of wood poles.

Figure 1:
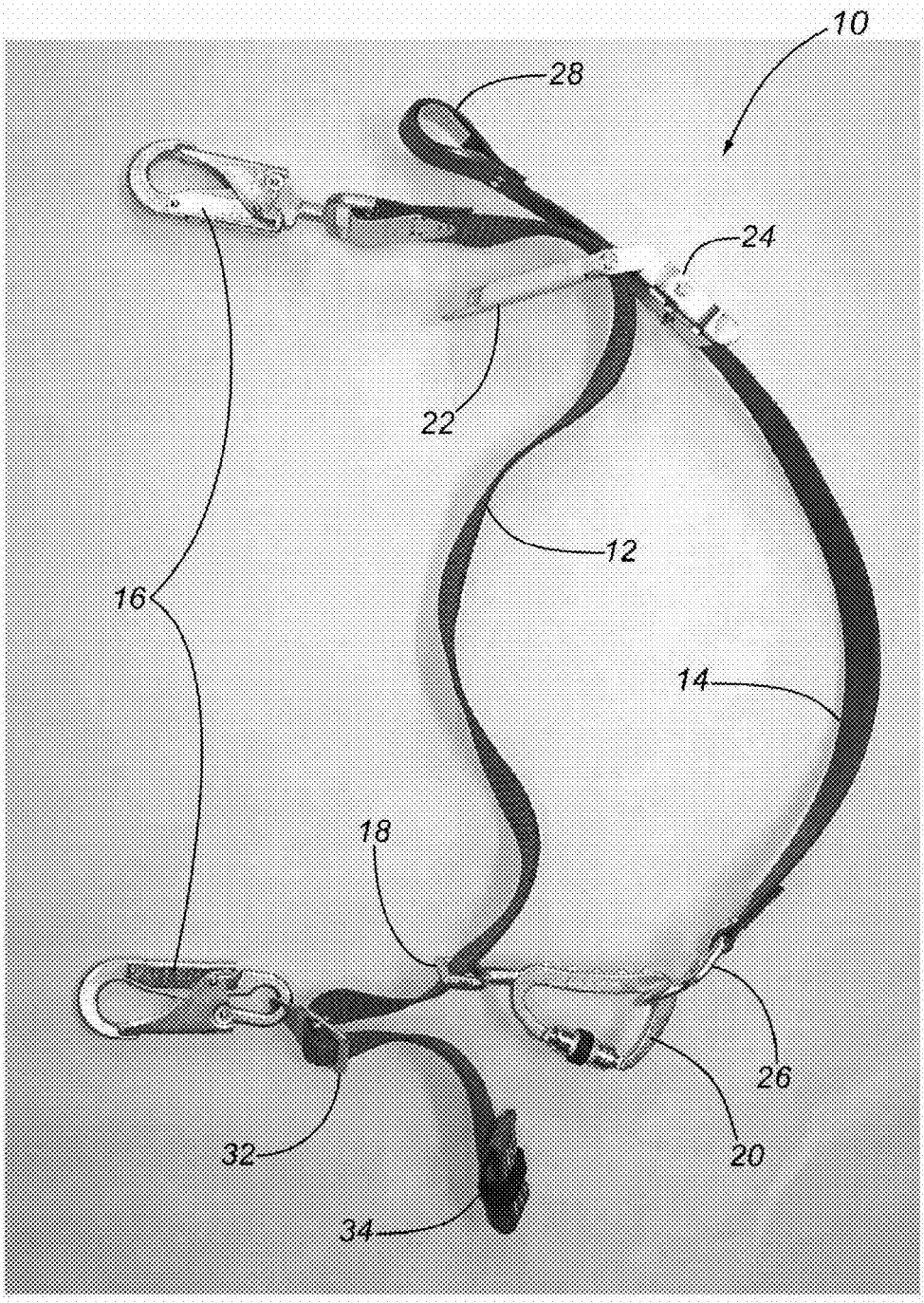
FIG.1 Prior Art
FIG. 1 is a perspective, plan, pictorial view of a fall restriction device of the prior art; specifically the fall restriction device of U.S. Pat. No. 6,752,242.

Referring first to FIG. 1, there is shown a perspective, pictorial view of a fall protection device 10 of the prior art, namely the fall protection device described in U.S. Pat. No. 6,752,242 included herein by reference.

Figure 2:
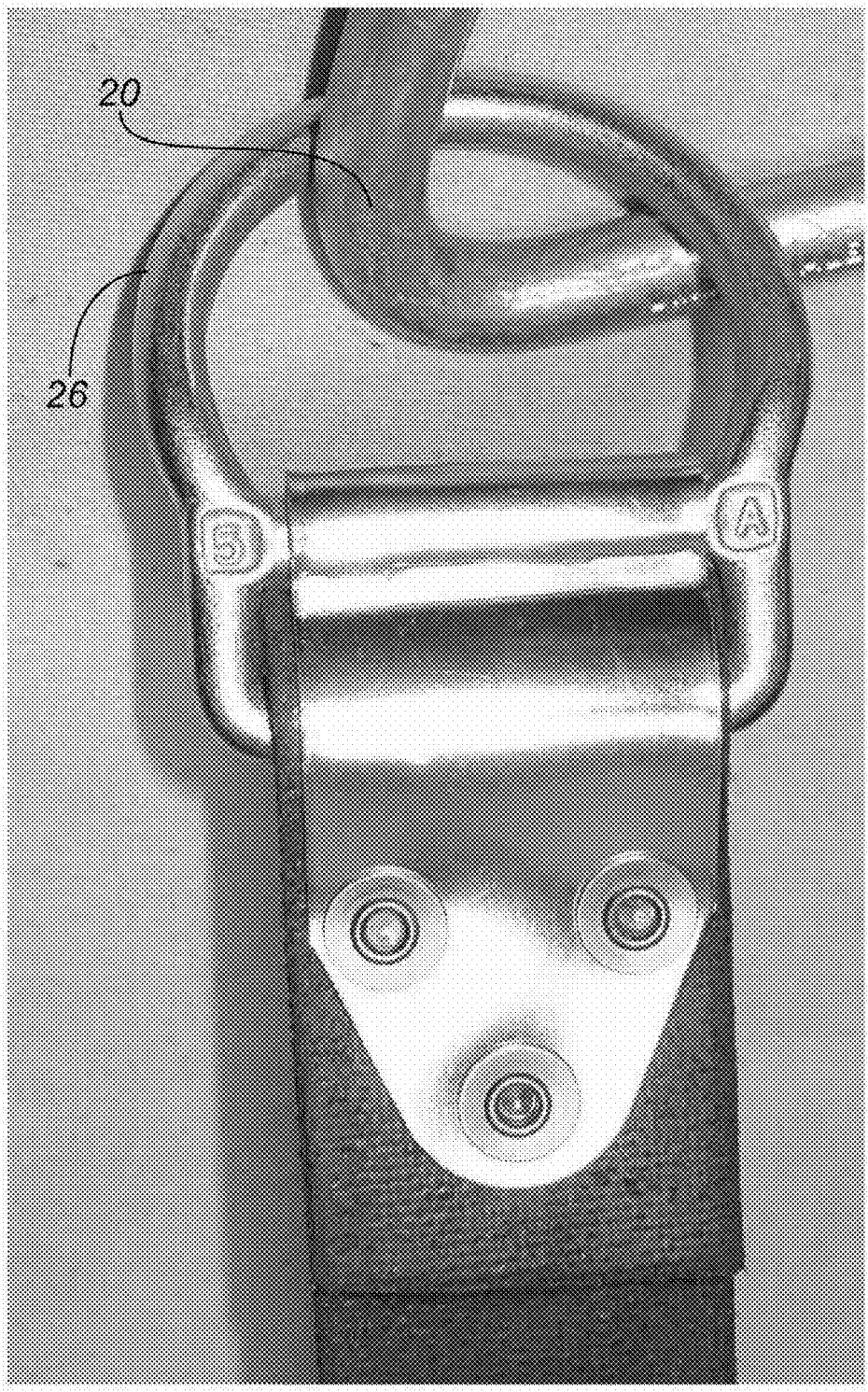
FIG.2 Prior Art
FIG. 2 is an enlarged, schematic view of a slotted D-piece assembly and a connector forming part of the fall restriction device of FIG. 1.

D-piece 18 is a conventional, single-opening D-piece believed to be well known to those of skill in the art. Likewise, connector 20 is a conventional connector having a substantially cylindrical and uniform cross section. Such connectors are also believed to be well known to those of skill in the art. FIG. 2 shows D-ring 26 connected to carabiner 20.

The inner strap 12 loops through the "D" piece 18 of a carabiner connector 20 that is attached to the outer strap 14 on a distal end thereof. The inner strap 12 loops through a cam buckle 24 that forms part of a handle/paddle 22. A distal end of the outer strap 14 attaches to the carabiner connector 20 through an intermediate ring connector 26. The other distal end of the outer strap 14 is characterized or defined by a loop 28. The outer strap 14 can be pushed through the cam buckle 24 to extend and enlarge a loop formed about a wooden pole, not shown. A pair of locking snap hooks 16 is provided to connect fall protection device 10 to a work positioning belt, not shown, typically used in conjunction with fall protection device 10. In one embodiment, a link 32 is attached to one of locking snap hooks 16. Link 32 may be used to tighten inner loop 12 using web handle 34 disposed at a distal end of link 32.

Figure 3B:
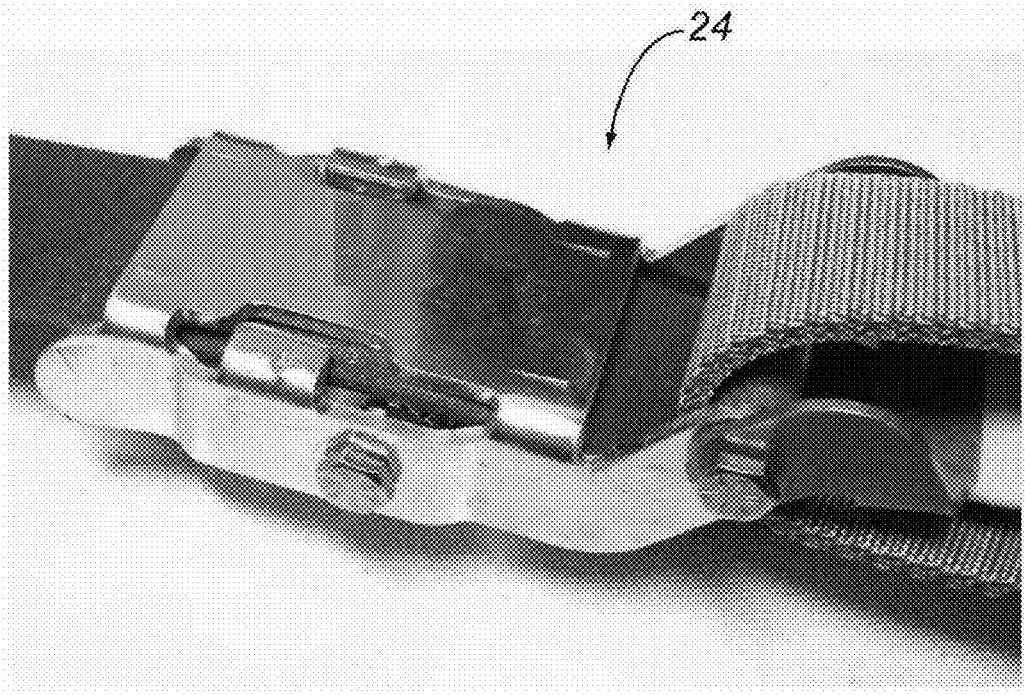
FIG.3b Prior Art
Figure 3B:
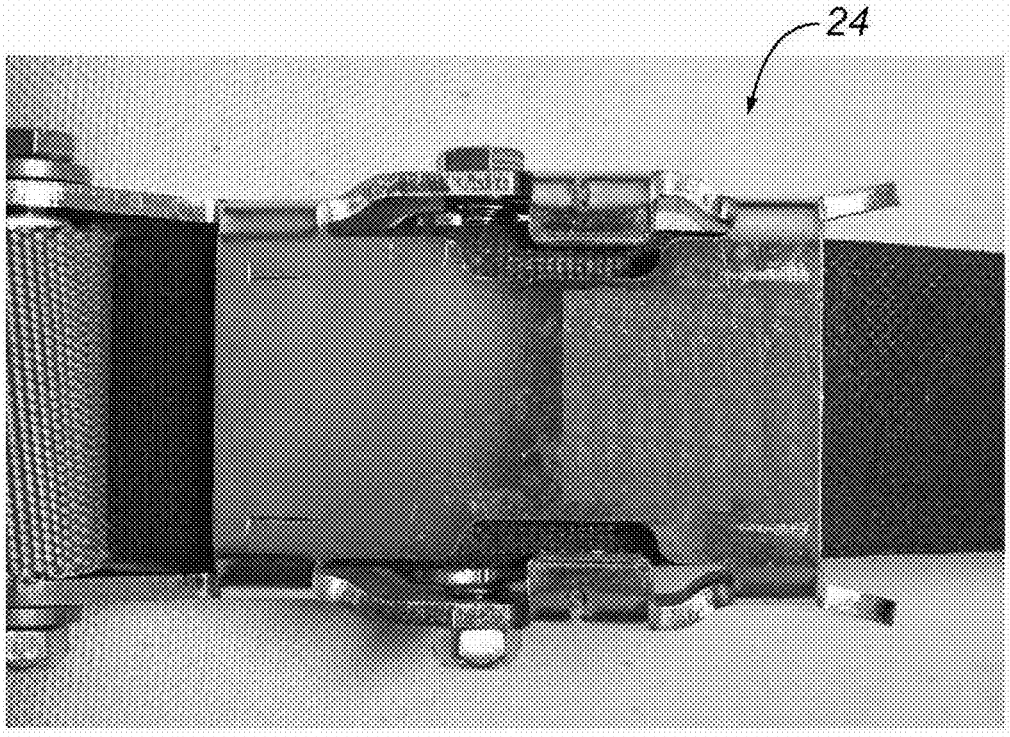
FIG.3b Prior Art
Figure 3C:
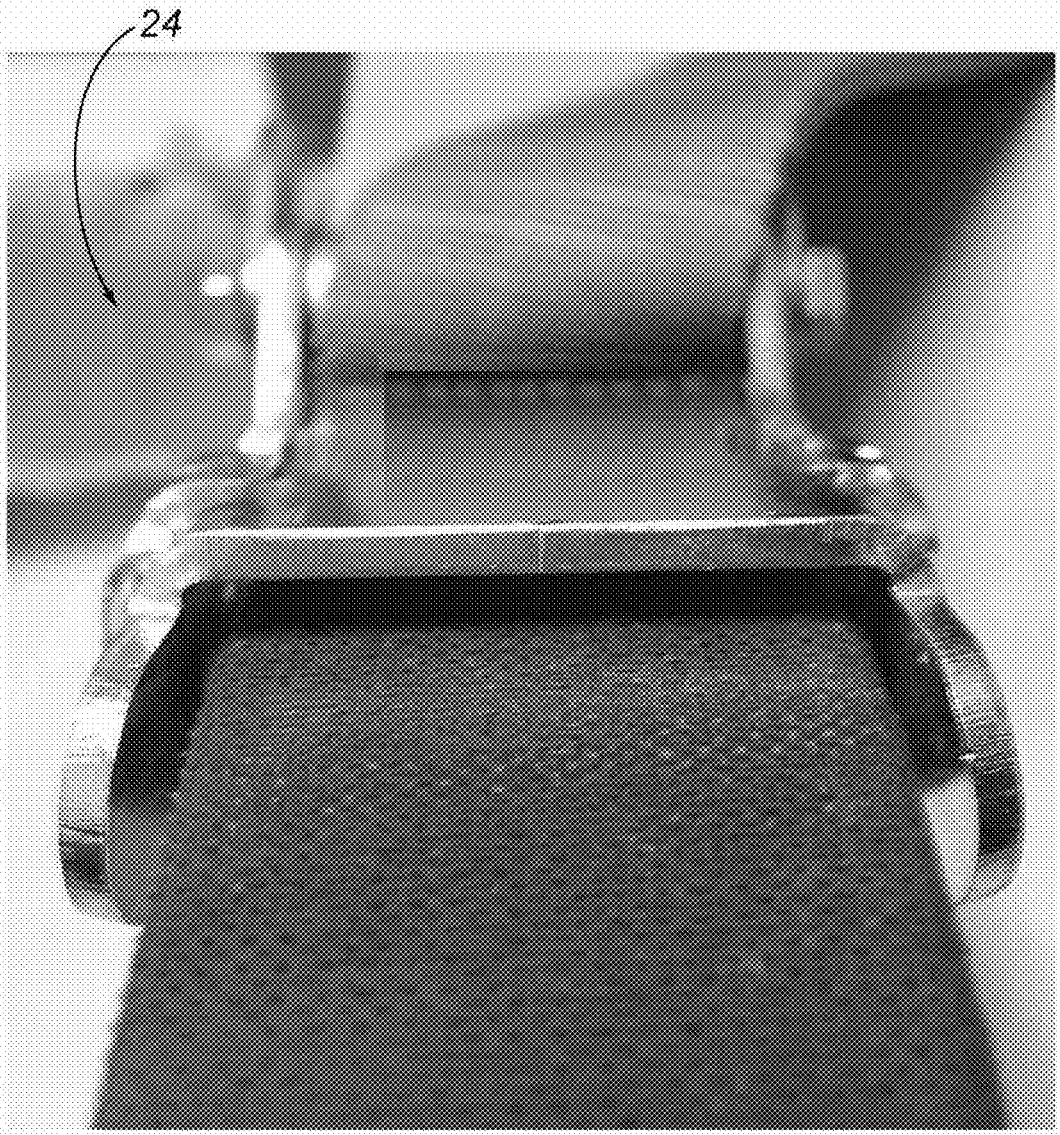
Prior Art FIG.3c

Additionally, buckle assembly 24 is a conventional cam style buckle having a substantially flat back surface, such cam buckles also being well known to those of skill in the art. FIGS. 3*a*-3*c* show two views of a rear surface and an end view, respectively, of buckle assembly 24.

Figure 4:
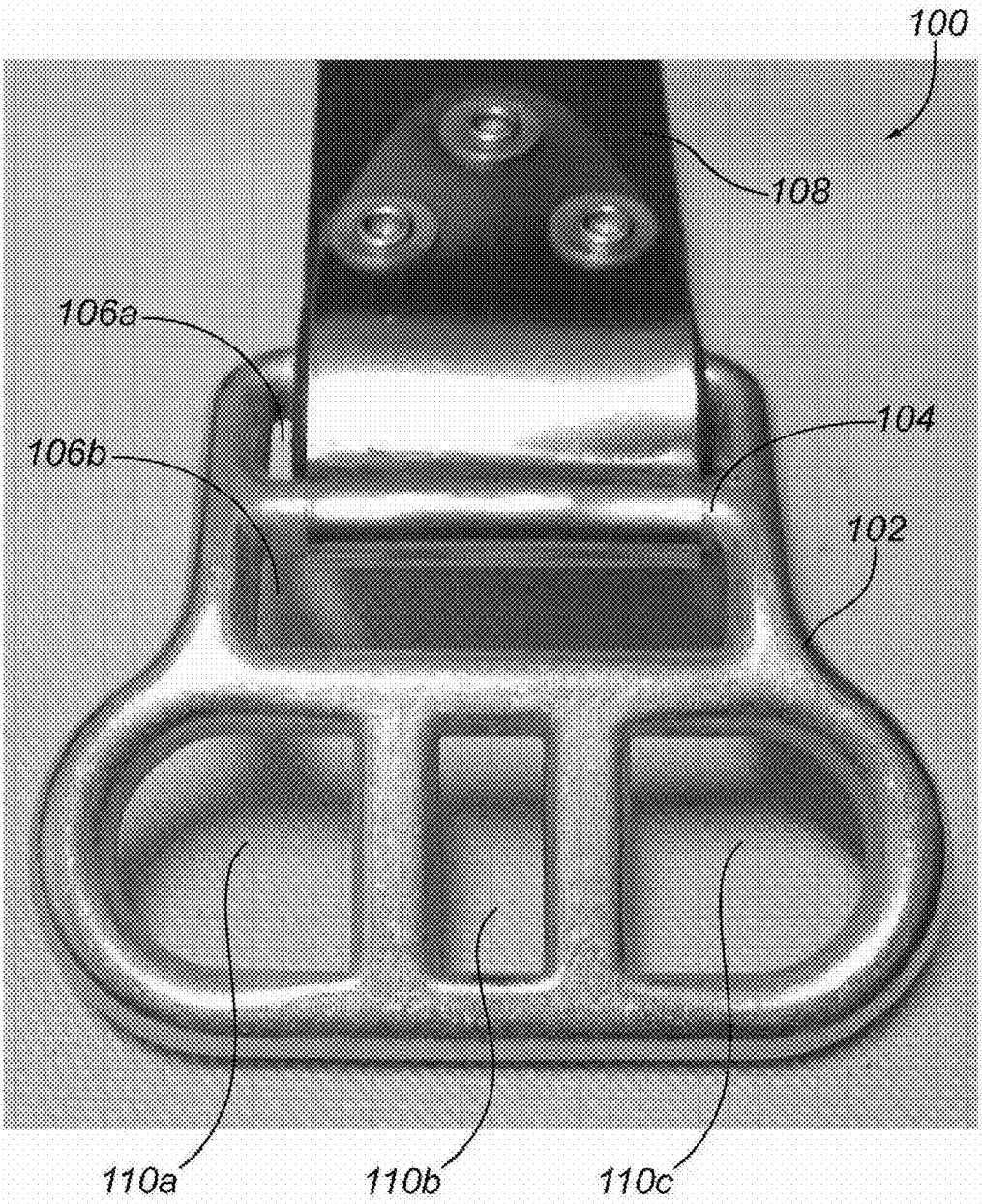
FIG.4 Prior Art
FIG. 4 is top plan view of a slotted D-piece assembly in accordance with the invention.

Referring now to FIG. 4, there is shown a top plan view of a unique slotted opening D-ring in accordance with the invention, generally at reference number 100. For brevity, slotted-opening D-ring 100 is abbreviated SOD-ring herein. SOD-ring 100 has a generally pear-shaped frame 102. A cross bar 104 defines openings 106*a*, 106*b* that allow SOD-ring 100 to be attached to a web 108 or similar structure. It should be noted that web 108 forms no part of the present invention but is included to show SOD-ring 100 in its intended operating environment.

Three operative openings 110*a*, 110*b*, 110*c* are provided in SOD-ring 100. A narrow, center opening 110*b* is surrounded by side openings 110*a*, 110*c*.

Figure 5A:
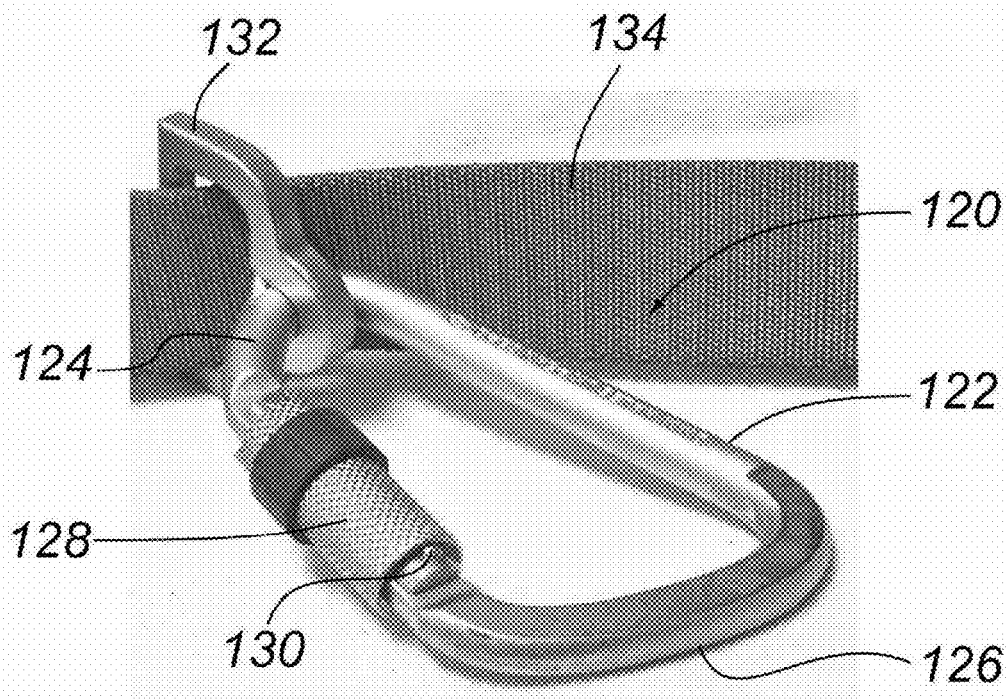
FIGS. 5*a* and 5*b* are top perspective and rear elevational views, respectively, of a first embodiment of a connector in accordance with the invention.
Figure 5B:
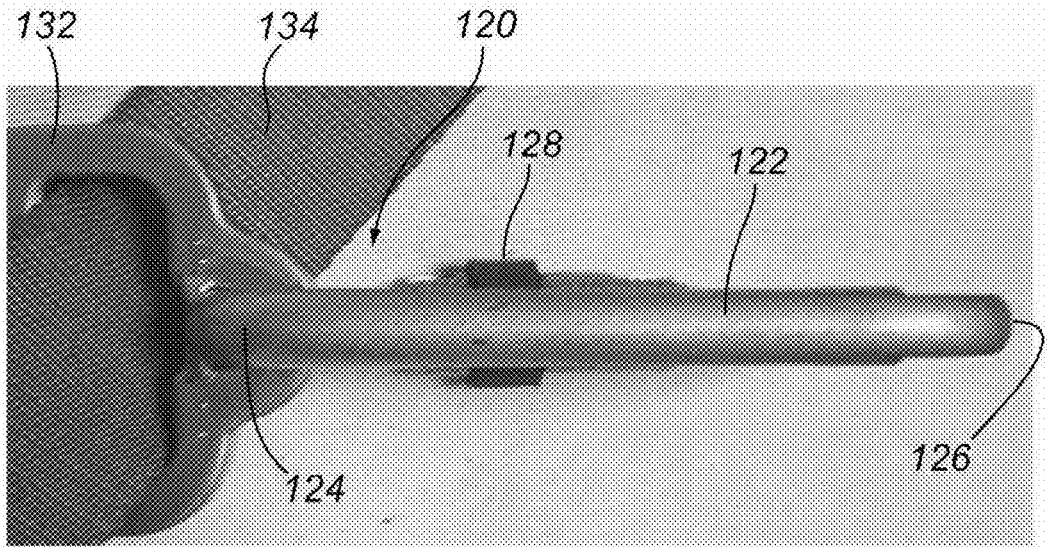

Referring now also to FIGS. 5*a* and 5*b*, there are shown top perspective and right side elevational views, respectively of a first embodiment of a connector in accordance with the invention, generally at reference number 120. Connector 120 is typically a D-shaped carabiner although it will be recognized by those of skill in the art that other standard or special carabiner shapes, snap hooks, or the like may be substituted therefor.

Connectors 120 are described as having a spine 122, a first bight portion 124 and a second bight portion 126. A closure 128 is hingedly attached to connecting component 120 at a proximal end 130 of second bight portion 126.

Second bight portion 126 is flattened to form a substantially rectangular cross section carabiner, although it will be recognized by those of skill in the art that other standard or special shapes may be utilized. The size and shape of the cross section of second bight portion 126 is chosen so that bight portion 126 fits within central opening 110*b* of SOD-ring 100, restraining connecting component 120 from rotating in SOD-ring 100.

It should be noted that first bight portion 124 maybe connected to a separate D-piece 132. A web 134 runs through D-piece 132. Neither D-piece 132 nor web 134 form part of the present invention but are shown to illustrate connector 120 in a typical operating environment.

Figure 5C:
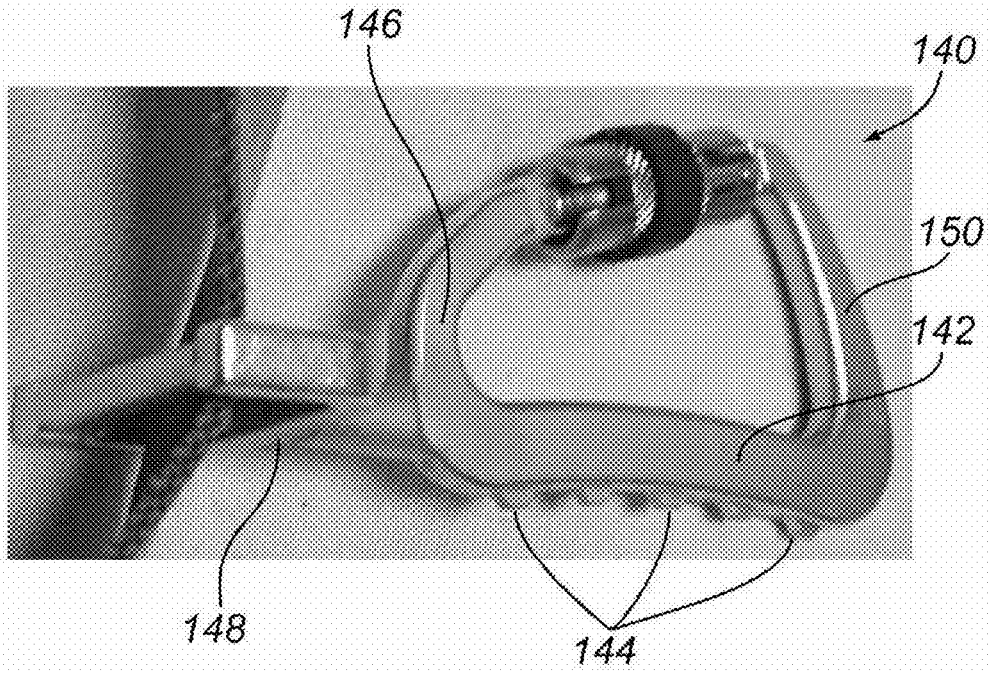
FIGS. 5*c* and 5*d* are top perspective and rear elevational views, respectively, of an alternate embodiment of a connector in accordance with the invention.
Figure 5D:
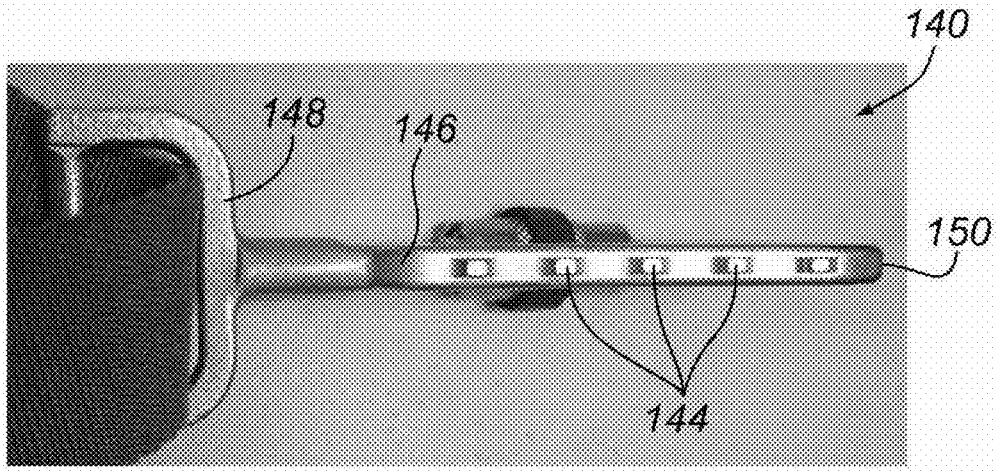

Referring now to FIGS. 5*c* and 5*d*, there are shown top perspective and rear elevational views, respectively, of an alternate embodiment of a connector in accordance with the invention, generally at reference number 140. Connector 140 has a substantially rectangular cross-section throughout its length although it will be recognized by those of skill in the art that other standard or special shapes may be utilized.

A spine 142 has a number of protrusions or spines 144 disposed on an external surface thereof. While spines 144 are shown only on spine 142 for purposes of disclosure, it will be recognized that spines 144 may extend onto first bight portion 146 and/or second bight portion 150 as required. As seen in FIG. 5*c*, spine portion 142 may be slightly curvilinear. The reasons for both the curvilinear shape and the protrusions or spines 144 are discussed in detail hereinbelow.

A first bight portion 146 may have a D-piece 148 rigidly affixed thereto. A major plane in which attached D-piece 148 lies is substantially orthogonal to a major plane in which the remainder of connector 140 lies.

Connector 140 has a second bight region 150 that, like the remainder of connector 140, has a substantially rectangular cross section although other standard or special shapes may be utilized. As described hereinabove, the second bight region 150 is sized and configured to fit into central opening 110*b* of SOD-ring 100, thereby preventing rotation of connector 140 therewithin.

Figure 6A:
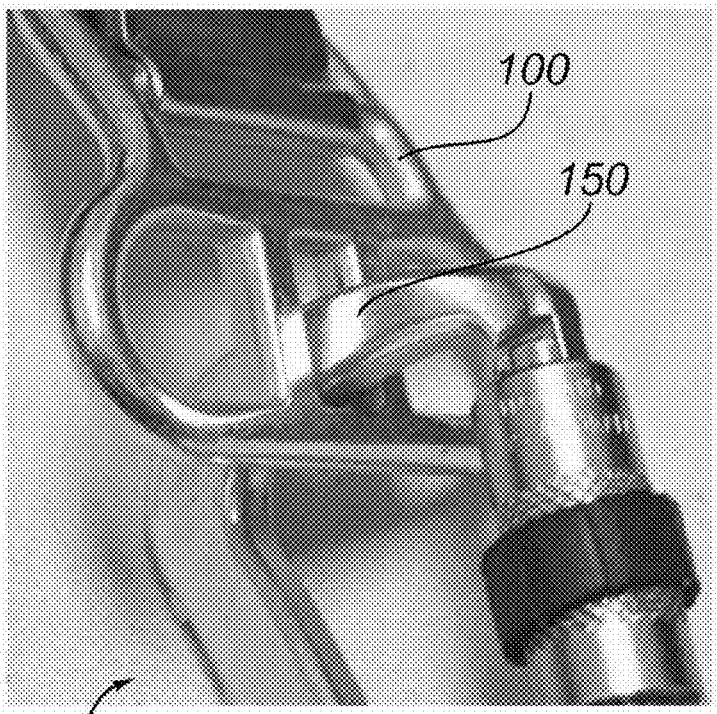
FIGS. 6*a* and 6*b* are top perspective views of the connector of FIGS. 5*a* and 5*b* attached to a center opening of the slotted D-ring of FIG. 4.
Figure 6B:
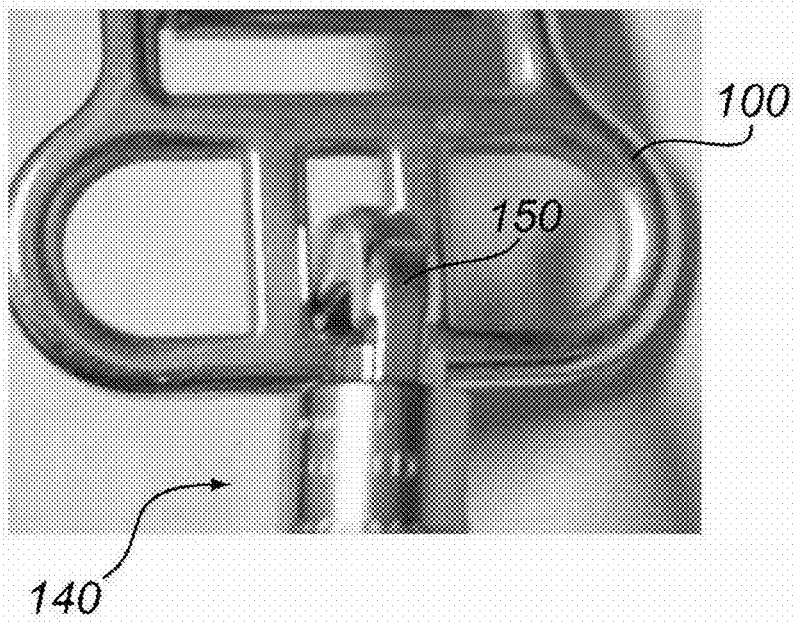

Referring now also to FIGS. 6*a* and 6*b*, there are shown top perspective and top views, respectively, of the connecting component 140 of FIGS. 5*c* and 5*d* attached to a center opening 110*b* of SOD-ring 100. While connecting component 140 is shown, it should be noted that a connecting component similar to component 120 or a snaphook may be interchanged therewith.

Second bight region 150 is shown positioned within central opening 110*b* of SOD-ring 100. As may be seen, the cross-sectional area of second bight portion 150 disallows rotation of connecting component 140 with respect to SOD-ring 100. Fixing the relationship between connecting component 140 and SOD-ring 100 has numerous safety and ease-of-operation advantages when connecting component 140 and SOD-ring 100 are assembled into the wood pole fall restriction device 180 (FIG. 8) of the invention.

Figure 7A:
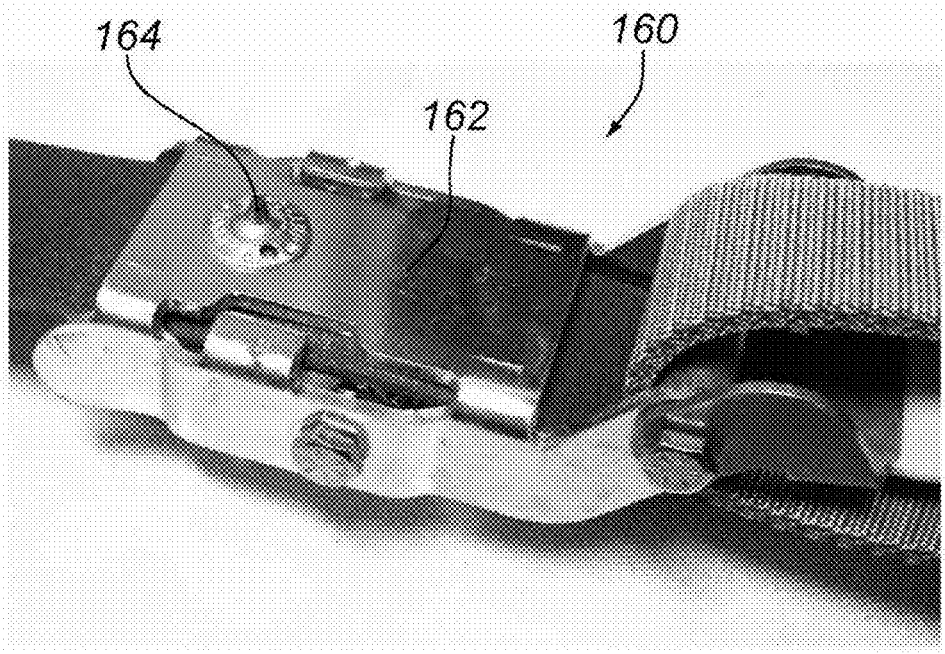
FIGS. 7*a*-7*c* are rear perspective, rear plan, and side elevational views, respectively, of a buckle assembly in accordance with the invention.
Figure 7B:
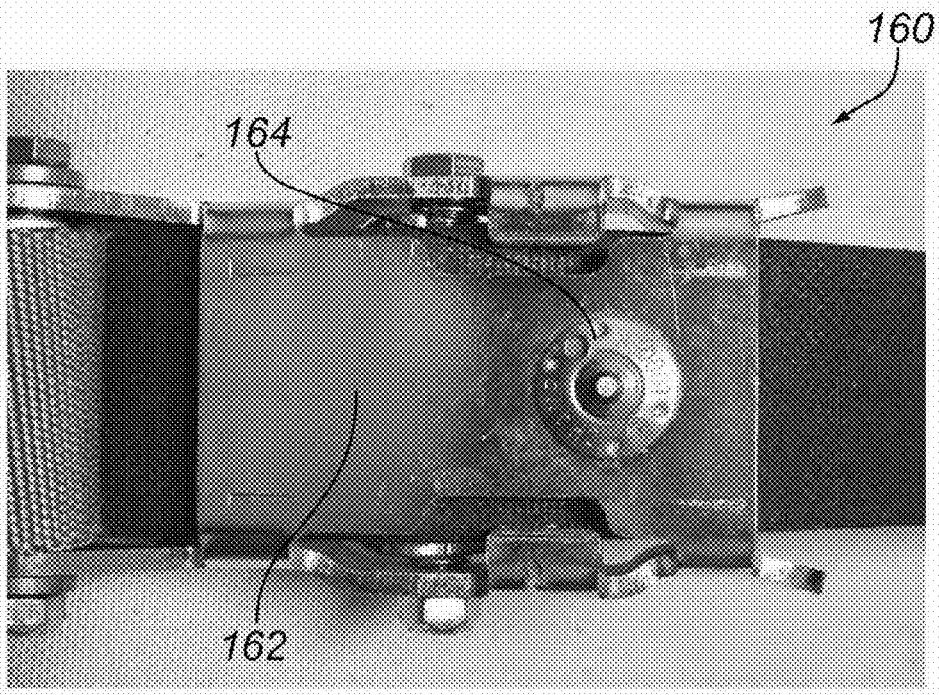
Figure 7C:
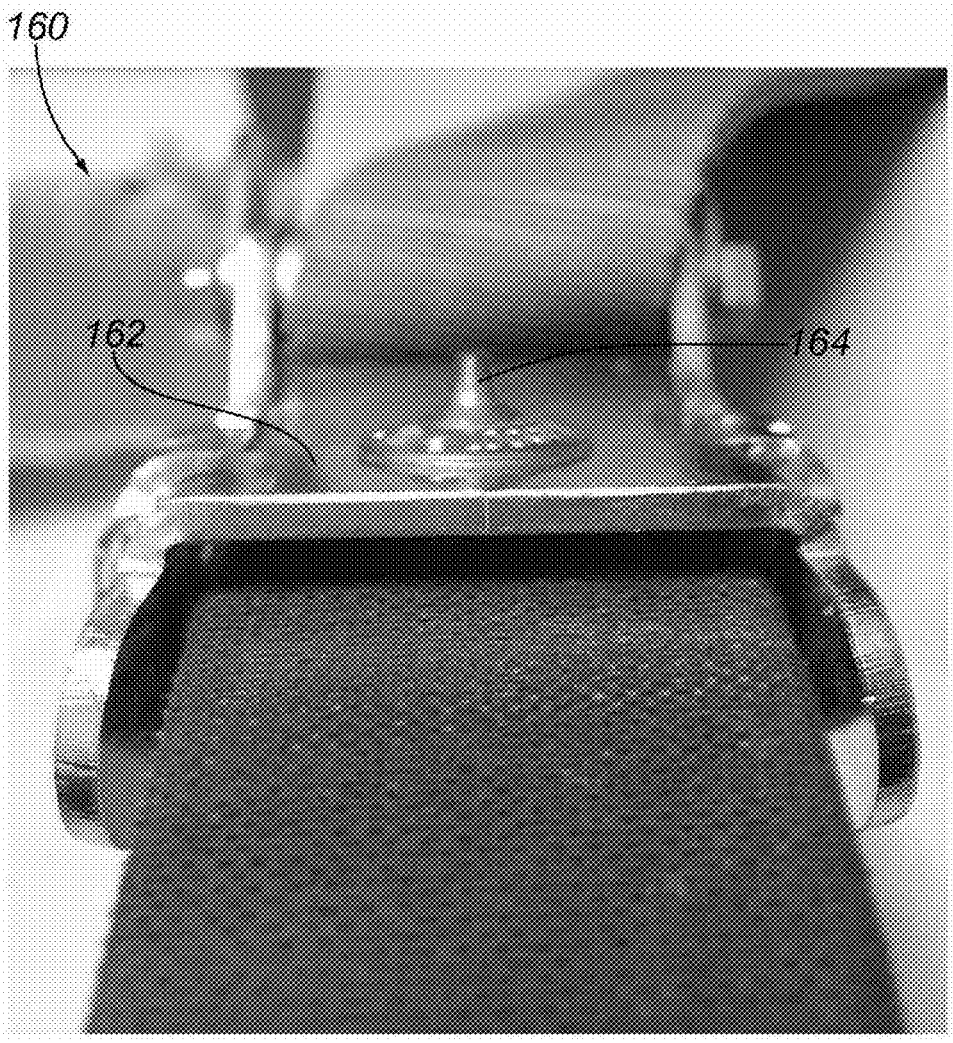

Referring now also to FIGS. 7*a*-7*c*, there are shown rear perspective, rear plan, and side elevational views, respectively, of a buckle assembly in accordance with the invention, generally at reference number 160. Buckle assemblies are believed to be known to those of skill in the art, so the specific structure and operation of such buckle assemblies are not described in detail herein.

Buckle assembly 160 has a rear surface 162 upon which may dispose one or more cleats 164. Cleats 164 are adapted to engage the wood pole, not shown, against which rear surface 162 of buckle assembly 160 rests when the inventive wood pole fall restriction device 180 utilizing buckle assembly 160 is in use by a wearer.

Figure 8:
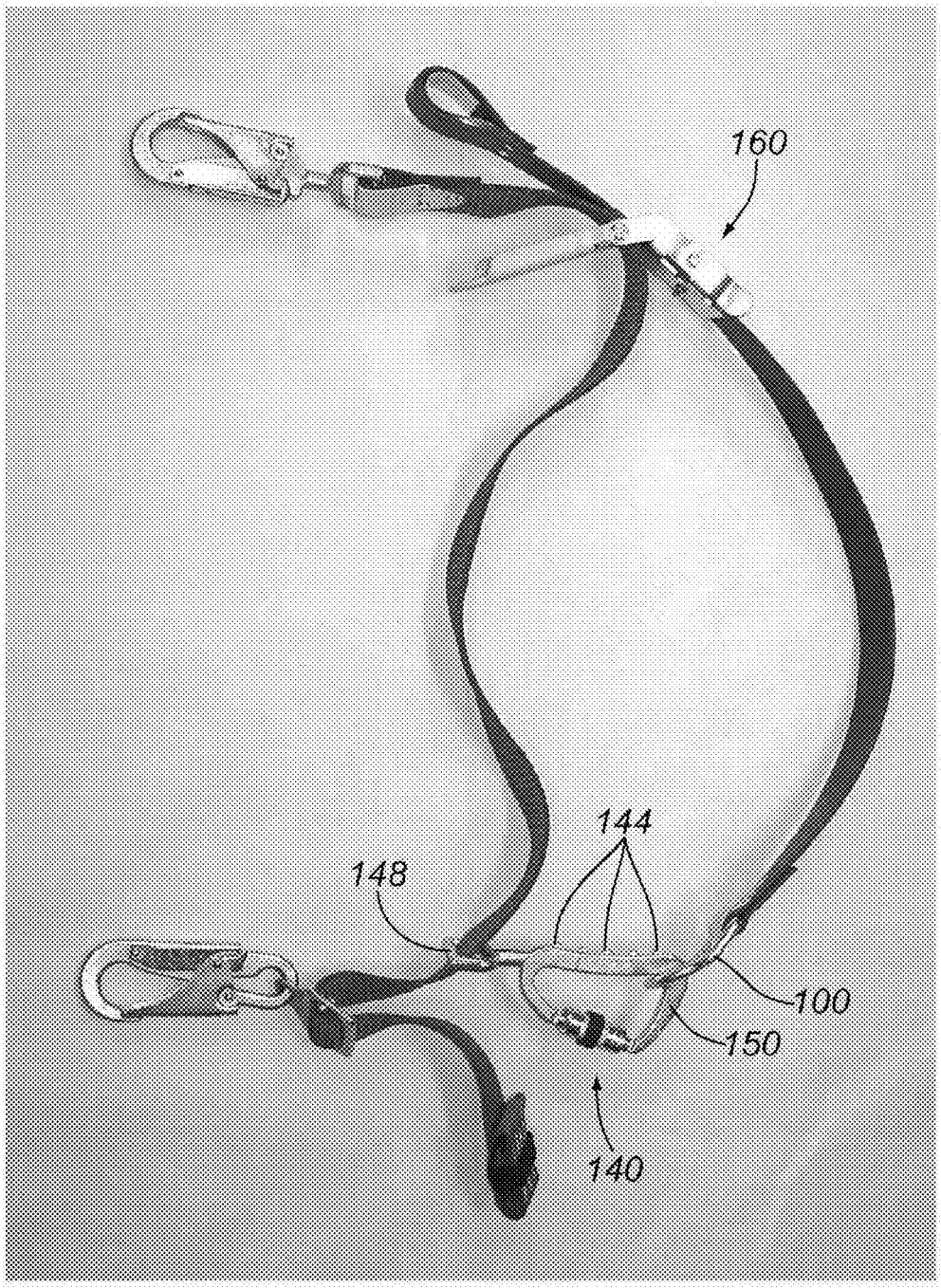
FIG. 8 is a top, plan, pictorial view of a wood pole fall restriction device in accordance with the invention.

Referring now to FIG. 8, there is shown a top, plan, pictorial view of a wood pole fall restriction device 180 in accordance with the invention and utilizing SOD-ring 100, connecting component 140 and buckle assembly 160.

The advantages of wood pole fall restriction device 180 are many. First, the anti-rotation feature achieved by the interaction of flattened second bight portion 150 of connecting component 140, or alternately, second bight portion 126 of connecting component, with central opening 110*b* of SOD-ring 100, allows an attached body belt, not shown, to be rigidly supported when grasping connecting component 120 or 140.

It will be recognized that connecting component 120 or 140 may alternately be attached to either of side openings 110*a*, 110*c* instead of to central opening 110*b*. This is particularly helpful in situations where the wearer does not have a good view of SOD-ring 100 (e.g., in dim light or when the view is otherwise obstructed). While the anti-rotation feature is defeated by such an action, the overall functionality of fall protector 180 is maintained.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A wood pole fall restriction device for pole climbers and line technicians that allows said pole climbers and line technicians to be fall protected and to negotiate obstacles and obstructions safely, comprising: an inner strap; an outer strap; a buckle assembly through which said outer strap passes, said buckle assembly having a first open buckle through which said inner strap passes; a connecting component disposed on a distal end of said outer strap, said connecting component having an opening through which said inner strap passes; and an adjustment link disposed on a distal end of said inner strap, the improvement comprising:

a connecting component connector comprising a three opening D-ring having a center opening disposed between a pair of side openings, said center opening having a length and a width, said side openings being larger than said center opening;

said connecting component comprising at least one selected from the group: a first bight portion, and a second bight portion sized and configured to fit within said center opening of said three opening D-ring, said connecting component thereby being prevented from rotating within said center opening; and wherein said center opening of said three opening D-ring is a substantially rectangular, oval or square shape and said at least one selected from the group: a first bight portion, and a second bight portion of said connecting component comprises a similar cross section along its length.

2. The wood pole fall restriction device as recited in claim 1, wherein said connecting component comprises at least one selected from the group: a D-shaped carabiner, a D-shaped snap hook, other generally D-shaped connector rigidly affixed thereto adjacent a first bight portion thereof.

3. The wood pole fall restriction device as recited in claim 2, wherein a major plane in which said attached selected connecting component lies is substantially orthogonal to a major plane in which the remainder of said connecting component lies.

4. The wood pole fall restriction device as recited in claim 1, wherein said connecting component comprises a spine portion having outward facing protrusions disposed on said spine portion.

5. The wood pole fall restriction device as recited in claim 1, the improvement further comprising:

a rear surface of said buckle assembly having at least one cleat disposed thereupon.

* * * * *